United States Patent [19]

Cobianco

[11] 4,387,480

[45] Jun. 14, 1983

[54] ADJUSTABLE BRUSH

[76] Inventor: Roger Cobianco, 85 Suncrest Dr., Safety Harbor, Fla. 33572

[21] Appl. No.: 260,978

[22] Filed: May 6, 1981

[51] Int. Cl.[3] ..... A46B 9/08

[52] U.S. Cl. ..... 15/169; 15/184

[58] Field of Search ..... 15/169, 166, 177, 180, 15/184, 204, 205, 199; 401/199; 431/316-318, 304-306

[56] References Cited

U.S. PATENT DOCUMENTS

| | | | |
|---|---|---|---|
| 53,923 | 4/1866 | Herr | 15/184 |
| 1,280,810 | 10/1918 | Morrison, Jr. | 15/204 |
| 3,029,456 | 4/1962 | Pharo | 15/180 |

FOREIGN PATENT DOCUMENTS

| | | | |
|---|---|---|---|
| 898169 | 6/1944 | France | 431/316 |
| 366027 | 1/1963 | Switzerland | 15/178 |

*Primary Examiner*—Peter Feldman

*Attorney, Agent, or Firm*—Stanley M. Miller

[57] ABSTRACT

An adjustable brush is disclosed which includes a hollow cylindrical housing having a main channel coaxial with the cylindrical axis thereof and opening onto a working end of the housing. The brush further includes a plurality of filamentary bristles slideably mounted in the channel of the housing for projecting a workpiece contacting end out from the working end of the housing. The brush further includes a selectively adjustable bristle retaining mechanism mounted on the housing and mechanically engaging the plurality of bristles, for retaining the contacting end of the bristles at selected projecting positions with respect to the working end of the housing. In this manner, the contacting end of the bristles can be renewed by selectively adjusting the bristle retaining mechanism and cutting the bristles to the desired shape.

15 Claims, 7 Drawing Figures

SEC. 2-2'

SEC. 5-5'

ADJUSTABLE BRUSH

FIELD OF THE INVENTION

The invention disclosed herein pertains to improvements in brushes and more particularly relates to improvements in adjustable brushes.

BACKGROUND OF THE INVENTION

Brushes have been used since prehistoric times to apply pigments to a workpiece. Many types of animal hair and vegetable fiber have been used in brush manufacture. In more modern times, synthetic fibers have been used. The brush fibers are united to handles of wood, plastic or metal in several different ways. The fibers are grouped into tufts and are cemented or clamped onto the brush handle.

When such brushes are used with paints which are not thoroughly cleaned from the brush bristles after use, the brush soon becomes heavy laden with dried paint, ruining the characteristics of the brush. Since the brush bristles are permanently bonded to the handle, the brush cannot be renewed and thus must be wastefully thrown away.

OBJECTS OF THE INVENTION

It is therefore an object of the invention to provide an improved brush in which the bristles can be renewed.

It is a further object of the invention to provide an improved renewable bristle brush which is simple in design and thus easy to manufacture.

SUMMARY OF THE INVENTION

These and other objects, features and advantages of the invention are accomplished by the adjustable brush disclosed herein. An adjustable brush is disclosed which includes a hollow cylindrical housing having a main channel coaxial with the cylindrical axis thereof and opening onto a working end of the housing. The brush further includes a plurality of filamentary bristles slideably mounted in the channel of the housing for projecting a workpiece contacting end out from the working end of the housing. The brush further includes a selectively adjustable bristle retaining mechanism mounted on the housing and mechanically engaging a plurality of bristles, for retaining the contacting end of the bristles at selected projecting positions with respect to the working end of the housing. In this manner, the contacting end of the bristles can be renewed by selectively adjusting the bristle retaining mechanism and cutting the bristles to the desired shape.

DESCRIPTION OF THE FIGURES

These and other objects, features and advantages of the invention will be more fully appreciated with reference to the accompanying figures.

DISCUSSION OF THE PREFERRED EMBODIMENT

Figure 1:
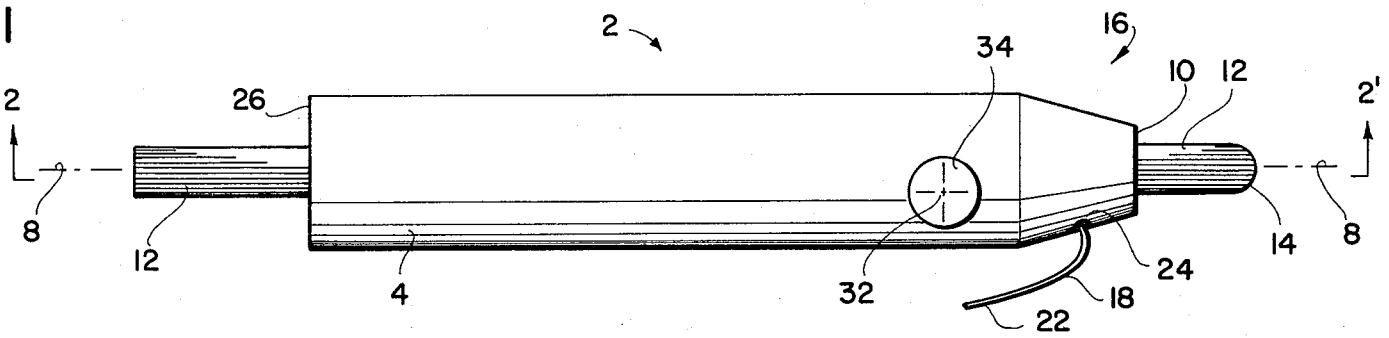
FIG. 1 is a top view of the adjustable brush invention.

An adjustable brush is disclosed which includes a hollow cylindrical housing having a main channel coaxial with the cylindrical axis thereof and opening onto a working end of the housing. The brush further includes a plurality of filamentary bristles slideable mounted in the channel of the housing for projecting a workpiece contacting end out from the working end of the housing. The brush further includes a selectively adjustable bristle retaining mechanism mounted on the housing and mechanically engaging the plurality of bristles, for retaining the contacting end of the bristle at selected projecting positions with respect to the working end of the housing. In the resulting device, the contacting end of the bristles can be renewed by selectively adjusting the bristle retaining mechanism and cutting the bristles to the desired shape.

As is shown in FIGS. 1 through 6, the adjustable brush 2 includes a hollow cylindrical housing 4 having a main channel 6 coaxial with the cylindrical axis 8 thereof and opening onto a working end 10 of the housing 4.

Figure 2:
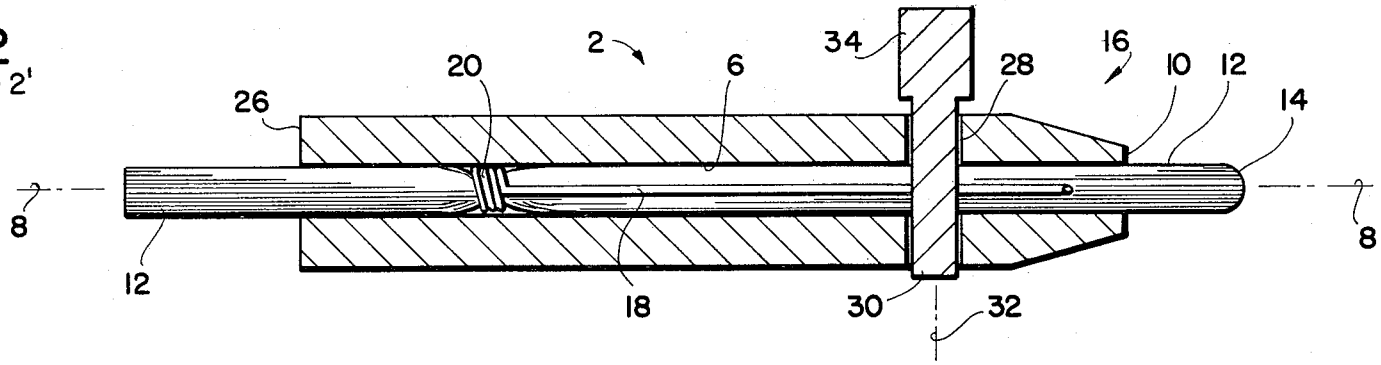
FIG. 2 is a side cross sectional view along section line 2–2′ of FIG. 1.
Figure 6:
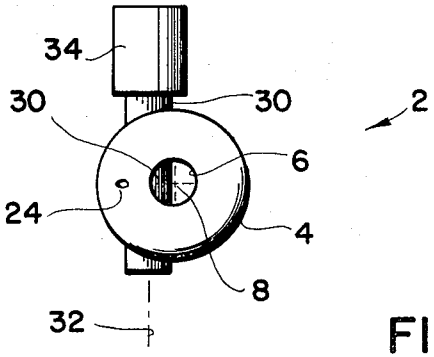
FIG. 6 is an end view as in FIG. 3, but with the bristles 12 and wire 22 removed.
Figure 3:
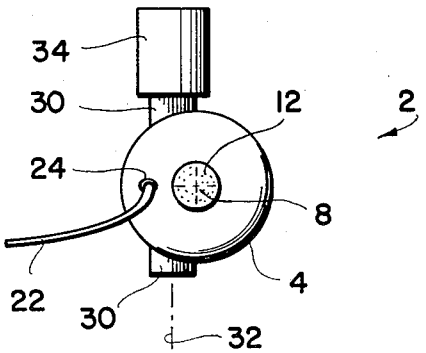
FIG. 3 is an end view of the adjustable brush invention.
Figure 4:
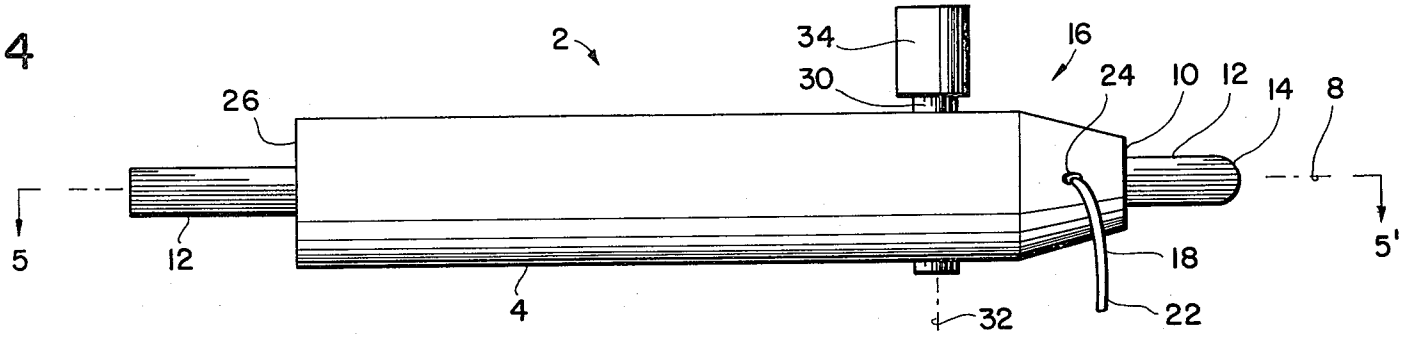
FIG. 4 is a side view of the adjustable brush invention.
Figure 5:
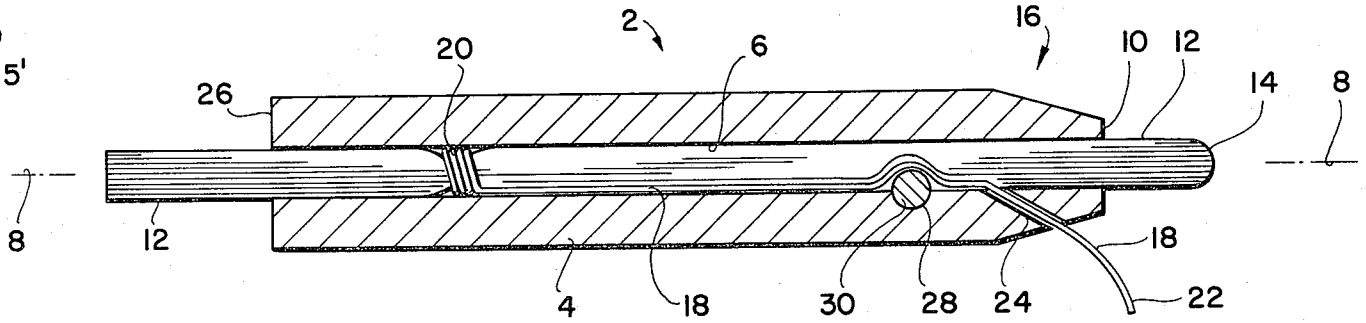
FIG. 5 is a top cross sectional view along section line 5–5′ of FIG. 4.
Figure 7:
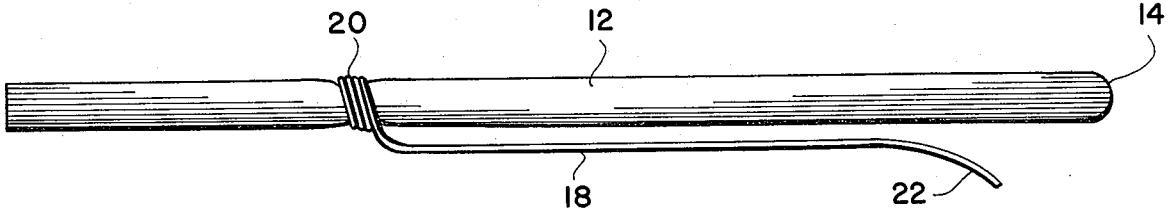
FIG. 7 is a top view of the bristles 12, showing how the wire 18 is bound thereto.

As is shown in FIGS. 2, 5 and 7, the brush also includes a plurality of filamentary bristles 12 slideably mounted in the channel 6 of the housing 4 for projecting a workpiece contacting end 14 out from the working end 10 of the housing 4.

As is shown in FIGS. 1 through 7, the brush also includes a selectively adjustable bristle retaining means 16 mounted on the housing 4 and mechanically engaging the plurality of bristles 12, for retaining the contacting end 14 of the bristles 12 at selected projecting positions with respect to the working end 10 of the housing 4.

In this manner, the contacting end 14, of the bristles 12 can be renewed by selectively adjusting the bristle retaining means 16 and cutting the bristles 12 to the desired shape.

The filamentary bristles 12 can be composed of such conventional materials as hog bristles, horse hair, nylon fiber, vinyl filaments, polyethylene fibers, polystyrene fibers, vegetable fibers and metal wire fibers.

The housing 4 can be composed of cast plastic, wood or metal and its simple cylindrical design is easy and inexpensive to manufacture.

As is shown in FIGS. 2, 5 and 7, the bristle retaining means 16 further includes a metal wire 18 having a first end 20 wrapped around the plurality of bristles 12 within the channel 6 and a second end 22 extending axially along the channel 6 and terminating outside the channel 6 for grasping by the operator to produce the selective adjustment. The wire 18 may be a metal such as copper, a plastic filament or a vegetable fiber or string. The first end 20 of the wire 18 may optionally be bonded to the bristles 12 by an adhesive or by thermoplastic bonding.

As is shown in FIG. 5, the housing 4 has a control channel 24 therethrough extending from the external surface thereof to the main channel 6, conducting the wire 18 therethrough.

The control channel 24 is oriented at an acute angle with respect to the cylindrical axis 8 of the housing 4.

The working end 10 of the housing 4 has a frustoconical shape.

The control channel 24 extends from the external surface of the frusto-conical shaped working end 10 of the housing 4, toward the opposite end 26 of the housing 4 from the working end 10 and intersecting the main channel 6.

The main channel 6 opens onto the opposite end 26 of the housing 4 so that the bristles 12 can be loaded into the housing 4 from the opposite end 26.

The bristle retaining means 16 includes the housing 4 having a transverse channel 28 of circular cross section therethrough extending from the external surface thereof to the main channel 6. As is shown in FIGS. 2 and 5, a cylindrical shaft 30 is rotatably mounted in the transverse channel 28 for frictional engagement with the plurality of bristles 12 within the main channel 6. In this manner, the bristles 12 may be retained at the selected positions.

The transverse channel 28 has its cylindrical axis 32 perpendicular to and non-intersecting with the axis 8 of the main channel 6. The cylindrical shaft 30 has its circumferential surface frictionally engage the plurality of bristles 12. In this manner, the rotation of the cylindrical shaft 30 about its axis 32 will advance the bristles 12 through the main channel 6.

The circumferential surface of the cylindrical shaft 30 may be knearled or coated with rubber or other compound to enhance the frictional engagement with the bristles 12.

As is shown in FIGS. 1, 2, 3, 4 and 6, the cylindrical shaft 30 further includes an adjustment handle 34 mounted to an end of the shaft 30 extending outside of the housing 4, for facilitating the manual rotation of the shaft 30 to selectively advance the bristles 12 along the main channel 6.

The rotation of the adjustment handle 34 can cooperate with the pull on the wire 18 by the operator to selectively advance the bristles 12. The shaft 30 can frictionally engage the wire 18 to uniformly advance the bristles 12 through the channel 6.

The resultant adjustable brush enables the renewal of the bristles and the customized shaping thereof, as desired. The structure is simple in design and therefor easy and inexpensive to manufacture.

Although a specific embodiment of the invention has been disclosed, it will be understood by those of skill in the art that minor changes can be made in the structure disclosed without departing from the spirit and the scope of the invention.

What is claimed is:

1. An adjustable brush, comprising:

a hollow cylindrical housing having a main channel coaxial with the cylindrical axis thereof and opening onto a working end of the housing;

a plurality of filamentary bristles slideably mounted in said channel of said housing for projecting a workpiece contacting end out from said working end of said housing;

a filament having a first end wrapped around said plurality of bristles within said channel and a second end extending axially along said channel and terminating outside said channel for grasping by the operator to produce a selective adjustment of the position of said bristles along said cylindrical axis;

whereby said contacting end of said bristles can be renewed by selectively adjusting said filament and cutting said bristles to the desired shape.

2. The adjustable brush of claim 1, which further comprises:

said housing having a control channel therethrough extending from the external surface thereof to said main channel, for conducting said filament therethrough.

3. The adjustable brush of claim 2, which further comprises:

said control channel being oriented at an acute angle with respect to said cylindrical axis of said housing.

4. The adjustable brush of claim 3, which further comprises:

said working end of said housing having a frusto-conical shape.

5. The adjustable brush of claim 4, which further comprises:

said control channel extending from said external surface of said frusto-conical shaped working end of said housing, toward the opposite end of said housing from said working end and intersecting said main channel.

6. The adjustable brush of claim 5, which further comprises:

said main channel opening onto said opposite end of said housing;

whereby said bristles can be loaded into said housing from said opposite end.

7. An adjustable brush, comprising:

a hollow cylindrical housing having a main channel coaxial with the cylindrical axis thereof and opening onto a working end of the housing;

a plurality of filamentary bristles slideably mounted in said channel of said housing for projecting a workpiece contacting end out from said working end of said housing;

a selectively adjustable bristle retaining means mounted on said housing and mechanically engaging said plurality of bristles, for retaining said contacting end of said bristles at selected projecting positions with respect to said working end of said housing;

a filament having a first end wrapped around said plurality of bristles within said channel and a second end extending axially along said channel and terminating outside said channel for grasping by the operator to produce a selective adjustment of the position of said bristles along said cylindrical axis;

whereby said contacting end of said bristles can be renewed by selectively adjusting said filament and cutting said bristles to the desired shape.

8. The adjustable brush of claim 7, wherein said bristle retaining means further comprises:

said housing having a transverse channel of circular cross section therethrough extending from the external surface thereof to said main channel;

a cylindrical shaft mounted in said transverse channel for frictional engagement with said plurality of bristles within said main channel;

whereby said bristles may be retained at said selected positions.

9. The adjustable brush of claim 8, which further comprises:

said transverse channel having its cylindrical axis perpendicular to and non-intersecting with said axis of said main channel;

said cylindrical shaft having its circumferential surface frictionally engage said plurality of bristles;

whereby the rotation of said cylindrical shaft about its said axis will advance said bristles through said main channel.

10. The adjustable brush of claim 9, wherein said cylindrical shaft further comprises:

an adjustment handle mounted to an end of said shaft extending outside of said housing, for facilitating the manual rotation of said shaft to selectively advance said bristles along said main channel.

11. The adjustable brush of claim 7, which further comprises:

said housing having a control channel therethrough extending from the external surface thereof to said main channel, for conducting said wire therethrough.

12. The adjustable brush of claim 11, which further comprises:

said control channel being oriented at an acute angle with respect to said cylindrical axis of said housing.

13. The adjustable brush of claim 12, which further comprises:

said working end of said housing having a frusto-conical shape.

14. The adjustable brush of claim 13, which further comprises:

said control channel extending from the external surface of said frusto-conical shaped working end of said housing, toward the opposite end of said housing from said working end and intersecting said main channel.

15. The adjustable brush of claim 14, which further comprises:

said main channel opening onto said opposite end of said housing;

whereby said bristles can be loaded into said housing from said opposite end.

* * * * *